US005554234A

United States Patent [19]

Takeuchi et al.

[11] Patent Number: 5,554,234

[45] Date of Patent: Sep. 10, 1996

[54] HIGH STRENGTH ALUMINUM ALLOY FOR FORMING FIN AND METHOD OF MANUFACTURING THE SAME

[75] Inventors: Hiroaki Takeuchi, Nikko; Hiroshi Kano, Imaichi, both of Japan

[73] Assignee: Furukawa Aluminum Co., Ltd., Tokyo, Japan

[21] Appl. No.: 362,746

[22] Filed: Dec. 22, 1994

Related U.S. Application Data

[63] Continuation of Ser. No. 83,918, Jun. 28, 1993, abandoned.

[51] Int. Cl.[6] ..... C22F 1/04

[52] U.S. Cl. ..... 148/551; 148/552; 148/693; 148/697; 148/698; 148/415; 148/437; 420/548; 420/551; 420/553

[58] Field of Search ..... 148/551, 552, 148/693, 697, 698, 415, 437; 420/548, 551, 553

[56] References Cited

U.S. PATENT DOCUMENTS

| | | | |
|---|---|---|---|
| 4,244,756 | 1/1981 | Tanabe et al. | 148/552 |
| 4,686,083 | 8/1987 | Takizawa et al. | 420/551 |
| 5,019,188 | 5/1991 | Hasenclever | 148/552 |

*Primary Examiner*—Melvyn Andrews

*Assistant Examiner*—Robert R. Koehler

*Attorney, Agent, or Firm*—Frishauf, Holtz, Goodman, Langer & Chick, P.C.

[57] ABSTRACT

The present invention provides a high strength aluminum alloy suitable for use in the manufacture of a fin, said aluminum alloy containing at most 0.1% by weight of Si, 0.10 to 1.0% by weight of Fe, 0.1 to 0.50% by weight of Mn, 0.01 to 0.15% by weight of Ti, and the balance of Al and unavoidable impurities, intermetallic compounds having a diameter not larger than 0.1 μm being distributed within the metal texture of the alloy in a number density of at least $10/\mu m^3$. The present invention also provides a method of manufacturing a high strength aluminum alloy suitable for use in the manufacture of a fin, comprising the steps of heating to 430° to 580° C. an aluminum alloy ingot of the composition noted above, applying a hot rolling treatment to said aluminum alloy ingot to obtain a plate material before the temperature of the aluminum alloy ingot is lowered by at most 50° C. from the temperature immediately after the heating step, applying a cold rolling treatment to the resultant plate material such that the final rate of reduction in the thickness of the plate material is at least 80%, and applying a homogenizing annealing treatment to the cold rolled thin plate material at 250° to 320° C. to cause intermetallic compounds having a diameter not larger than 0.1 μm to be distributed within the metal texture of the alloy in a number density of at least $10/\mu m^3$.

2 Claims, 3 Drawing Sheets

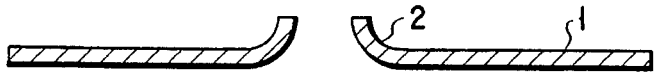
FIG. 1A
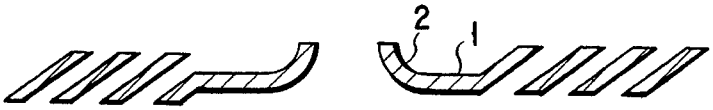
FIG. 1B
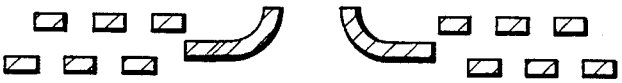
FIG. 1C
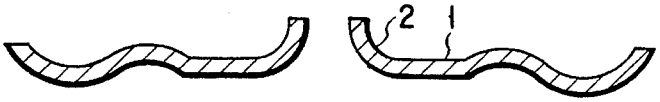
FIG. 1D
FIG. 2A
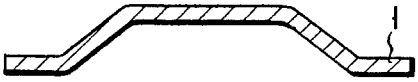
FIG. 2B
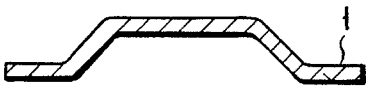
FIG. 2C
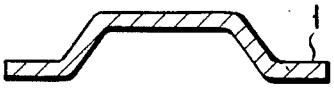
FIG. 2D
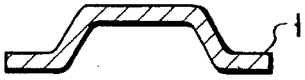
FIG. 2E
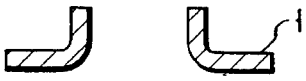
FIG. 2F
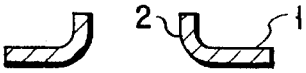

HIGH STRENGTH ALUMINUM ALLOY FOR FORMING FIN AND METHOD OF MANUFACTURING THE SAME

This application is a Continuation of application Ser. No. 08/083,918, filed Jun. 28, 1993, now abandonded.

BACKGROUND OF THE INVENTION

1. Field of the Invention

The present invention relates to a high strength aluminum alloy used for forming fins included in a room air conditioner, said alloy being subjected to at least one of a draw forming, a drawless forming and a combination of thereof such as an extension process, a squeezing process, a barring process, a bashing process, or a reflare process for preparation of fins included in a room air conditioner, and also relates to a method of manufacturing the same.

2. Description of the Related Art

In general, an aluminum alloy fin included in a heat exchanger for an air conditioner comprises a plate portion 1 and a collar portion 2 to which a heat exchanger tube is mounted, as shown in FIGS. 1A to 1D. Depending on the shape of the plate portion 1, the aluminum alloy fin is classified into a flat type as shown in FIG. 1A, a roover type as shown in FIG. 1B, a slit type as shown in FIG. 1C, and a corrugation type as shown in FIG. 1D.

FIGS. 2A to 2F collectively show how to apply a draw forming, which is essentially based on an extension process, to an aluminum alloy plate for preparation of an aluminum alloy fin. It is seen that an extension process as shown in FIG. 2A is applied first to the plate portion 1, followed by applying a squeezing process as shown in FIGS. 2B to 2D and subsequently applying a punching process and a barring process as shown in FIG. 2E. Finally, a reflare process is applied to the aluminum alloy plate to form a collar portion 2 as shown in FIG. 2F. Since the draw forming shown in FIGS. 2A to 2F is based on the extension process, the fin material is required to exhibit an excellent elongation. To meet the requirement, used in general is a thick alloy plate material having a homogenizing treatment applied thereto and having a thickness of at least 0.12 mm. For example, O material or H22 material is used in general for forming an aluminum alloy fin. It should also be noted that, in the case of applying a draw forming treatment to a thin aluminum alloy plate having a thickness not larger than 0.115 mm, problems are brought about such as a forming deterioration and an insufficient mechanical strength. Such being the situation, it is very difficult to prepare a fin of a small thickness or to achieve a high collar height-forming of a thin plate material by using alloy materials available nowadays.

For overcoming the problems described above, a drawless forming, which is based on a bashing process, has come to be a main stream in the manufacture of a fin these several years. FIGS. 3A to 3D collectively show the drawless forming technique. Specifically, a punching-hole expanding process as shown in FIG. 3A is applied in the first step to a plate portion 1, followed by applying a barring process as shown in FIG. 3B and subsequently applying a bashing process as shown in FIG. 3C. Finally, a reflare process is applied as shown in FIG. 3D. The drawless forming, which is employed in general for the manufacture of a thin fin having a thickness not larger than 0.12 mm, permits decreasing the thickness of the fin to about 0.115 to 0.105 mm in the low collar height-forming technique.

The material to which the drawless forming is applied requires an excellent bashing workability and a reasonable mechanical strength. In general, semi-hard materials such as H24 to H26 materials are used as the material meeting the above-noted requirements. However, it is still difficult to achieve a high collar height-forming of a thin plate material having a thickness not larger than 0.12 mm by means of the drawless forming. In such a case, it is unavoidable nowadays to use a alloy plate material having a large thickness.

What should also be noted is that, in the case of preparing a pre-coated fin (surface treated fin) by means of the drawless forming technique, a defective forming is derived from the wear of the mold and the molding tool during the pressing process over a long period of time. Naturally, it is necessary to apply maintenance periodically to the mold and the molding tool, leading to a high maintenance cost. Thus, it is strongly desired in this technical field to maintain a high molding capability and to lower the maintenance cost of the mold and the molding tool.

An additional difficulty to be noted is that, in the drawless forming technique, the deterioration of moldability is likely to be brought about in many cases by the decrease in viscosity of the lubricating oil as in the case of using, for example, a volatile oil.

In recent years, a composite forming utilizing the draw forming and the drawless forming in combination has come to be employed in many cases. FIGS. 4A to 4F collectively shows the composite forming technique noted above. In the composite forming technique, an extension process shown in FIG. 4A is applied first to the plate portion 1, followed by applying a squeezing process as shown in FIG. 4B and subsequently applying a punching and barring process as shown in FIG. 4C to the raw material alloy plate. Further, a bashing process as shown in FIGS. 4D and 4E and a reflare process as shown in FIG. 4F are successively applied to the raw material so as to obtain a desired fin.

In the composite forming technique outlined above, a collar portion having a reasonable height is prepared by the extension process and the subsequent squeezing process, followed by applying a bashing process. The particular technique permits diminishing the bashing rate, compared with the drawless forming technique. When it comes to an aluminum alloy plate which is widely used nowadays as a fin material, however, it is still impossible to maintain sufficiently a satisfactory molding capability and to lower sufficiently the maintenance cost of the mold and the molding tool even in the case of employing the composite forming technique.

SUMMARY OF THE INVENTION

The present inventors have conducted an extensive research in an attempt to overcome the above-noted problems inherent in the prior art so as to clarify various problems to be solved and to arrive at measures for solving these problem.

It has been found that a first problem to be solved is that, in the case of a soft fin material used in the conventional draw forming technique, the fin material fails to exhibit a sufficiently high mechanical strength when the thickness of the fin material is decreased to 0.12 mm or less. It follows that buckling takes place when a copper tube is inserted into the collar portion of the fin, resulting in failure to ensure a high bonding strength between the collar portion and the heat exchanger tube. In this case, the heat exchange performance is lowered. On the other hand, the hard fin material used in the conventional drawless forming technique certainly exhibits a high mechanical strength, making it possible to decrease the thickness of the fin material. However, the conventional hard fin material is low in its elongation, making it difficult to achieve a high collar height forming by employing the draw forming technique.

It has also been found as a second problem that, in the case of the drawless forming technique, it is difficult to suppress markedly the problems such as deterioration in the moldability caused by, for example, the decrease in the viscosity of the lubricating oil and the formation of the pre-coated film and the wear of the molding tool accompanying the pressing step over a long period of time.

It may be possible to solve the second problem noted above, i.e., to suppress the deterioration of the moldability caused by the decrease of the lubricating function and to lower the high maintenance cost derived from the wear of the molding tool, if it is possible to prepare a hard pre-coated fin having a thickness not larger than 0.12 mm by the draw forming technique. It has been found as a third problem, however, that the conventional hard material is low in its elongation, making it impossible to obtain a satisfactory fin by the draw forming technique in the case of using a thin raw material plate having a thickness not larger than 0.105 mm.

As pointed out previously, a volatile oil has come to be used in order to omit the washing step after the molding or forming step. In accordance with the use of the volatile oil, a composite forming technique utilizing the draw forming technique and the drawless forming technique in combination has come to be employed in this technical field. In the composite forming technique, a reasonable collar height is obtained by the extension process and the squeezing process, followed by applying a bashing process so as to diminish the bashing rate. If a hard pre-coated fin having a thickness not larger than 0.12 mm can be obtained by the composite forming technique, it is certainly possible to overcome the third problem noted above, i.e., to suppress the deterioration of moldability and to lower the high maintenance cost derived from the wear of the molding tool. However, the conventional hard material is low in its elongation, giving rise to a fourth problem that it is difficult to obtain a satisfactory fin even by the composite forming technique in the case of using a thin raw material plate having a thickness not larger than 0.105 mm.

It has also been found as a fifth point that a thin fin having a thickness not larger than 0.12 mm can be obtained by the draw forming technique, the drawless forming technique or the composite forming technique, if it is possible to obtain a raw material plate exhibiting a mechanical strength and moldability required for the draw forming technique and the elongation and the moldability required for the drawless forming technique.

Further, it has been found as a sixth point that it is possible to obtain the state of the metal texture defined in the present invention as claimed by controlling the addition amounts of Si, Fe, Mn, Ti and the manufacturing process and conditions of the required alloy so as to arrive at the material described above in conjunction with the fifth point.

According to a first aspect of the present invention, there is provided a high strength aluminum alloy suitable for use in the manufacture of a fin, said aluminum alloy containing at most 0.1% by weight of Si, 0.10 to 1.0% by weight of Fe, 0.1 to 0.50% by weight of Mn, 0.01 to 0.15% by weight of Ti, and the balance of Al and unavoidable impurities, intermetallic compounds having a diameter not larger than 0.1 μm being distributed within the metal texture of the alloy in a number density of at least $10/\mu m^3$.

According to a second aspect of the present invention, there is provided a method of manufacturing a a high strength aluminum alloy suitable for use in the manufacture of a fin, comprising the steps of heating to 430° to 580° C. an aluminum alloy ingot containing at most 0.1% by weight of Si, 0.10 to 1.0% by weight of Fe, 0.1 to 0.50% by weight of Mn, 0.01 to 0.15% by weight of Ti, and the balance of Al and unavoidable impurities; applying a hot rolling treatment to said aluminum alloy ingot to obtain a plate material before the temperature of the aluminum alloy ingot is lowered by at most 50° C. from the temperature immediately after the heating step; applying a cold rolling treatment to the resultant plate material such that the final rate of reduction in the thickness of the plate material is at least 80%; and applying a homogenizing annealing treatment to the cold rolled thin plate material at 250° to 320° C. to cause intermetallic compounds having a diameter not larger than 0.1 μm to be distributed within the metal texture of the alloy in a number density of at least $10/\mu m^3$.

According to a third aspect of the present invention, there is provided a method of manufacturing a high strength aluminum alloy suitable for use in the manufacture of a fin, comprising the steps of continuously supplying an aluminum alloy melt containing at most 0.1% by weight of Si, 0.10 to 1.0% by weight of Fe, 0.1 to 0.50% by weight of Mn, 0.01 to 0.15% by weight of Ti, and the balance of Al and unavoidable impurities to the outer circumferential surfaces of a pair of cooling molds disposed to face each other and rotated in a sliding contact with each other to obtain a cast plate having a thickness of 2 to 15 mm; applying a cold rolling treatment to the resultant cast plate such that the final rate of reduction in the thickness of the cast plate is at least 80%; and applying a homogenizing annealing treatment to the cold rolled thin plate at 250° to 320° C. to cause intermetallic compounds having a diameter not larger than 0.1 μm to be distributed within the metal texture of the alloy in a number density of at least $10/\mu m^3$.

Further, according to a fourth embodiment of the present invention, there is provided a method of manufacturing a high strength aluminum alloy suitable for use in the manufacture of a fin, comprising the steps of applying a homogenizing treatment at 400° to 500° C. for 1 to 30 hours to an aluminum alloy ingot containing at most 0.1% by weight of Si, 0.10 to 1.0% by weight of Fe, 0.1 to 0.50% by weight of Mn, 0.01 to 0.15% by weight of Ti, and the balance of Al and unavoidable impurities; applying a hot rolling treatment to the aluminum alloy ingot immediately after the homogenizing treatment such that the homogenized aluminum alloy plate having a thickness of 100 mm is passed through a hot rolling apparatus at least 7 times so as to decrease the thickness of the homogenized aluminum plate into a desired thickness after the hot rolling step; applying a cold rolling treatment to the resultant hot rolled plate such that the final rate of reduction in the thickness of the hot rolled plate is at least 80%; and applying a homogenizing annealing treatment to the cold rolled thin plate at 250° to 320° C. to cause intermetallic compounds having a diameter not larger than 0.1 μm to be distributed within the metal texture of the alloy in a number density of at least $10/\mu m^3$.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates presently preferred embodiments of the invention and, together with the general description given above and the detailed description of the preferred embodiments given below, serves to explain the principles of the invention.

FIGS. 1A to 1D are cross sectional views collectively showing an aluminum alloy fin used in a heat exchanger for an air conditioner;

FIGS. 2A to 2F are cross sectional views collectively showing a draw forming technique employed for manufacturing an aluminum alloy fin used in a heat exchanger for an air conditioner;

DETAILED DESCRIPTION OF THE PREFERRED EMBODIMENTS

Figure 3A:
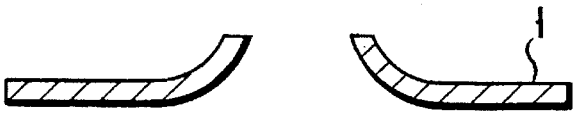
FIGS. 3A to 3D are cross sectional views collectively showing a drawless forming technique employed for manufacturing an aluminum alloy fin used in a heat exchanger for an air conditioner.
Figure 3B:
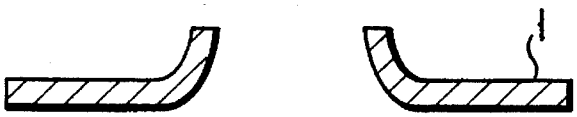
Figure 3C:
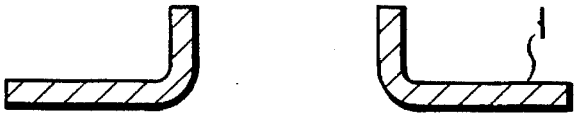
Figure 3D:
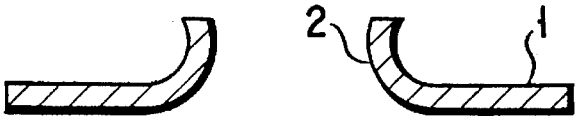
Figure 4A:
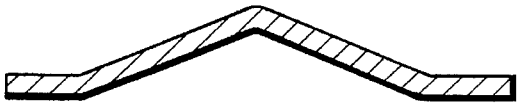
FIGS. 4A to 4F are cross sectional views collectively showing a composite forming technique employed for manufacturing an aluminum alloy fin used in a heat exchanger for an air conditioner.
Figure 4B:
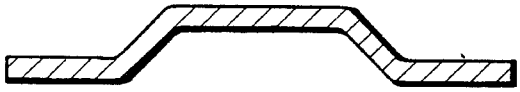
Figure 4C:
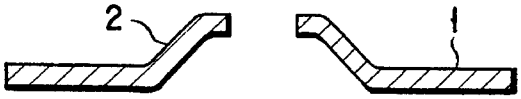
Figure 4D:
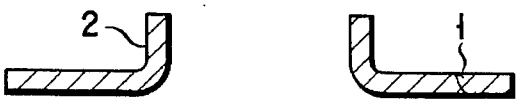
Figure 4E:
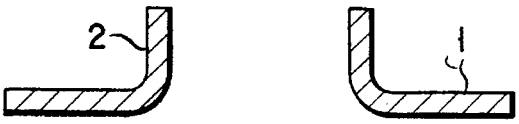
Figure 4F:
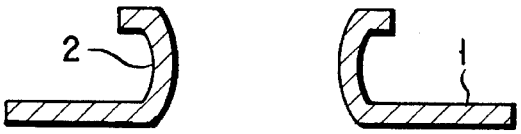

According to a first aspect of the present invention, there is provided a high strength aluminum alloy suitable for use in the manufacture of a fin, said aluminum alloy containing at most 0.1% by weight of Si, 0.10 to 1.0% by weight of Fe, 0.1 to 0.50% by weight of Mn, 0.01 to 0.15% by weight of Ti, and the balance of Al and unavoidable impurities, intermetallic compounds having a diameter not larger than 0.1 μm being distributed within the metal texture of the alloy in a number density of at least $10/\mu m^3$.

In the present invention, Si, Fe and Mn contained in the aluminum-based alloy partly form a solid solution within the alloy so as to improve the mechanical strength of the fin material. Particularly, manganese is effective for improving the elongation of the alloy material.

Titanium contained in the aluminum-based alloy also forms partly a solid solution within the alloy so as to make the texture of the alloy finer. In particular, titanium serves to permit the restoration to proceed uniformly in the homogeneous annealing step so as to make the subgrains uniform and finer, with the result that the extension and squeezing processes are further improved. Titanium is also said to improve the local elongation of the alloy material. Particularly where a reflare process as in, for example, a flange formation is included in the manufacture of a fin, the moldability of the raw material alloy plate tends to be improved with increase in the local elongation. Such being the situation, it is important to define the Ti content in the present invention.

Where the amount of each of Fe and Mn contained in the aluminum-based alloy used in the present invention is smaller than 0.10% by weight, these metal elements fail to form a solid solution within the alloy as desired, resulting in failure to obtain a desired mechanical strength and elongation of the alloy. In addition, the amount of the fine intermetallic compounds having a diameter not larger than 0.1 μm, are formed as a result of Fe and Mn addition, is diminished, with the result that, in the working texture of the final alloy plate, the function of suppressing the growth of the restoring subgrains is diminished in the homogeneous annealing step. It follows that it is unavoidable to lower the mechanical strength of the alloy in order to ensure a desired elongation of the alloy. Also, the bashing property and the reflare property are lowered in the composite forming technique. What should also be noted in this connection is that the subgrains tend to be distributed nonuniformly, leading to a poor extension property, a poor squeezing property, etc. in the actual draw forming technique. Further, an insufficient amount of Fe and Mn causes the resultant alloy not to exhibit a sufficient mechanical strength, leading to a poor formed article of fins.

On the other hand, it is important for the Si addition not to exceed 0.1% by weight, for the Fe addition not to exceed 1.00% by weight and for the Mn addition not to exceed 0.50% by weight in the present invention. Where the amounts of these additives are larger than the upper limits described above, the intermetallic compounds formed in the alloy are rendered unduly bulky, with the result that the amount of the intermetallic compounds not larger than 0.1 μm is diminished. Also, the deposits in the forging step are rendered bulky. It follows that it is necessary to add silicon in an amount of at most 0.1% by weight. On the other hand, it is necessary to add iron in an amount falling within a range of between 0.10 and 1.0% by weight. Likewise, it is necessary to add manganese in an amount falling within a range of between 0.10 and 0.50% by weight.

where the amount of the titanium addition is less than 0.01% by weight, it is impossible to obtain the effect of making the subgrains uniform and fine. In addition, it is impossible to further improve the moldability, particularly the extension property, the squeezing property and the reflare property. On the other hand, if the amount of the titanium addition exceeds 0.15% by weight, Ti-based bulky compounds are distributed within the alloy, resulting in failure to make the subgrains uniform and finer. It follows that it is necessary to add titanium in an amount falling within a range of between 0.01 and 0.15% by weight.

In the present invention, it is also possible to add traces of other elements such as Zr, Cu, Y and Hf so as to improve the balance between the mechanical strength and the elongation of the resultant alloy and to improve the moldability.

In the present invention, it is necessary for the fine intermetallic compounds within the metallic texture of the alloy before the molding step to have a diameter not larger than 0.1 μm. If the intermetallic compounds have a diameter larger than 0.1 μm, the function of retarding the migration of the grain boundary of the restoring subgrains is impaired in the homogenizing annealing step in the working texture of the final alloy plate material, with the result that it is unavoidable to lower the mechanical strength of the alloy plate material in order to ensure a desired value of elongation. Further, the subgrains tend to be distributed nonuniformly. It follows that the extension property, the squeezing property, the reflare property, etc. are lowered in the actual draw forming process or a composite forming process. In addition, the final alloy plate fails to exhibit a sufficient mechanical strength, with the result that the molded article of fins is likely to be unsatisfactory.

It is also defined in the present invention that the intermetallic compounds having a diameter not larger than 0.1 μm should be distributed in a number density of at least $10/\mu m^3$. Where the number density of the particular intermetallic compounds is less than $10/\mu m^3$, it is difficult to obtain the particular effects of the present invention described above, resulting in failure to obtain the effect of improving extension property, the squeezing property, the reflare property, the mechanical strength, etc. of the alloy plate.

According to a second aspect of the present invention, there is provided a method of manufacturing a a high strength aluminum alloy suitable for use in the manufacture of a fin. The method of the present invention comprises the step of heating to 430° to 580° C. an aluminum alloy ingot specified previously in conjunction with the first aspect of the present invention. The particular heat treatment is intended to suppress formation of bulky deposits during the homogenizing treatment so as to promote formation of fine intermetallic compounds having a diameter not larger than 0.1 μm during the hot rolling step or the homogenizing annealing step. To achieve the object, the aluminum alloy ingot is heated to 430° to 580° C. so as to initiate the hot rolling treatment in the holding time as short as possible.

If the homogenizing annealing treatment is applied to the ingot at a temperature lower than 430° C., it is impossible to homogenize sufficiently the texture of the ingot. As a result, the working texture after the hot rolling treatment is rendered nonuniform, leading to deterioration of the extension property, the squeezing property and the reflare property in the draw forming process or the deterioration of the bashing property and the reflare property in the composite forming process. On the other hand, if the homogenizing annealing treatment is carried out at a temperature higher than 580° C, it is certainly possible to obtain a sufficient degree of solid solution. However, the precipitates are rendered bulky and spherical, with the result that the moldability of the resultant alloy plate is adversely affected.

It should also be noted that the precipitates are rendered bulky with increase in the holding time regardless of the temperature in the homogenizing annealing step. Naturally, it is desirable to shorten the holding time as much as possible. In practice, it is desirable to set the holding time at 4 hours or less. What should also be noted is that a hot rolling treatment is applied to the alloy ingot immediately after the heating of the aluminum alloy ingot to a desired temperature. In the present invention, the hot rolling treatment should be initiated before the temperature of the aluminum alloy ingot is lowered to a level at most 50° C. lower than the temperature immediately after completion of the heating step.

Where the hot rolling treatment is initiated at a temperature lower by more than 50° C. than the temperature at the completion of the heating step of the aluminum ingot, the amount of the element forming a solid solution within the alloy is markedly decreased in the stage of initiating the hot rolling treatment, with the result that bulky compounds larger than 0.1 μm are deposited in a large amount within the aluminum matrix. In this case, fine intermetallic compounds having a diameter not larger than 0.1 μm are unlikely to be deposited during the hot rolling step or during the hot rolling step and the homogenizing annealing step after the cold rolling step, resulting in failure to obtain the particular distribution of the intermetallic compounds defined in the present invention. It follows that it is necessary to initiate the hot rolling treatment at a temperature at most 50° C. lower than the temperature at the completion stage of the heating step of the aluminum alloy ingot.

Further, in the method of the present invention, a cold rolling treatment is applied to the hot rolled plate material such that the final rate of reduction in the thickness of the plate material is at least 80%. If the final rate of reduction noted above is less than 80%, the plate material fails to exhibit a sufficient mechanical strength, giving rise to, for example, a buckling problem in the case where an alloy plate having a thickness not larger than 0.120 mm is prepared by means of the draw forming technique or the composite forming technique.

Still further, a homogenizing annealing treatment is applied in the method of the present invention to the resultant cold rolled plate material at a temperature falling within a range of between 250° C. and 320° C. so as to ensure a mechanical strength required for the manufacture of a thin fin by the composite forming technique and an elongation required for the draw forming technique. It follows that the homogenizing annealing treatment specified in the present invention permits ensuring satisfactory extension property, squeezing property, hole-expanding property, bashing property and reflare property. In addition, the corrugating property can also be improved.

where the homogenizing annealing treatment is carried out at a temperature lower than 250° C., it is impossible to obtain a satisfactory moldability. On the other hand, if the temperature for the homogenizing annealing treatment is higher than 320° C., the mechanical strength of the resultant alloy plate material is lowered. In addition, the elongation of the alloy plate material is also impaired. Further, recrystallized grains are formed within the aluminum matrix so as to bring about deterioration of the moldability. It follows that it is necessary to apply the cold rolling treatment under the thickness reduction rate of at least 80%, followed by applying a homogenizing annealing treatment to the cold rolled plate material at a temperature falling within a range of between 250° C. and 320° C.

According to a third aspect of the present invention, there is provided a method of manufacturing a high strength aluminum alloy suitable for use in the manufacture of a fin, comprising the steps of continuously supplying an aluminum alloy melt of the composition described previously to the outer circumferential surfaces of a pair of cooling molds disposed to face each other and rotated in a sliding contact with each other to obtain a cast plate having a thickness of 2 to 15 mm; applying a cold rolling treatment to the resultant cast plate such that the final rate of reduction in the thickness of the cast plate is at least 80%; and applying a homogenizing annealing treatment to the cold rolled thin plate at 250° to 320° C. so as to promote formation of intermetallic compounds having a diameter not larger than 0.1 μm.

In the method of the present invention, it is important to supply continuously an aluminum alloy melt to the outer circumferential surfaces of a pair of cooling molds disposed to face each other and rotated in a sliding contact with each other to obtain a cast plate having a thickness of 2 to 15 mm. If the cast plate is thinner than 2 mm, the solidifying state in the casting step is rendered unstable, giving rise to defects such as cracking and pin hole occurrence. If the cast plate is thicker than 15 mm, however, the cooling rate is lowered in the casting step, leading to reduction in the amount of the element forming a solid solution within the aluminum matrix. In this case, the intermetallic compounds deposited within the aluminum matrix grow unduly large, resulting in failure to obtain the texture described previously. It follows that it is necessary to supply the aluminum alloy melt to obtain a cast plate having a thickness falling within a range of between 2 mm and 15 mm. Incidentally, it is also possible to employ any of a water cooling rolling method, a caster method, etc. in the step of obtaining the cast plate noted above.

As in the second aspect described previously, the cold rolling treatment is carried out under at least 80% of a reduction rate of the plate material in the method according to the third aspect of the present invention. Likewise, the homogenizing annealing treatment is applied to the cold rolled thin plate material at a temperature falling within a range of between 250° C. and 320° C. in the third aspect as in the second aspect described previously.

According to a fourth aspect of the present invention, there is provided a method of manufacturing a high strength aluminum alloy suitable for use in the manufacture of a fin, comprising the step of applying a homogenizing treatment to an aluminum alloy ingot of the composition described previously. The particular homogenizing treatment, which is carried out under temperatures falling within a range of between 400° C. and 500° C. for 1 to 30 hours, is intended to suppress formation of large deposits so as to promote precipitation of fine intermetallic compounds having a diameter not larger than 0.1 μm in the subsequent hot rolling step or the homogenizing annealing step.

If the homogenizing treatment is carried out under temperatures lower than 400° C., it is impossible to homogenize sufficiently the texture of the aluminum alloy ingot. In this case, since it is impossible to decrease the amount of the additive elements which were forced to form a solid solution within the aluminum matrix in the casting step, the alloy material is likely to be hardened in the step of the bashing treatment, leading to crack occurrence in the molded article of fins. In addition, the texture after the hot rolling step is rendered nonuniform, resulting in deterioration of the extension property, squeezing property and reflare property in the draw forming process or the composite forming process. On the other hand, if the homogenizing treatment is carried out under temperatures higher than 500° C., it is certainly possible to ensure a sufficiently high degree of solid solution. However, the deposited intermetallic compounds are rendered bulky and spherical, with the result that the moldability of the resultant alloy plate material is adversely affected. Particularly, it is difficult to obtain a sufficient precipitation of fine intermetallic compounds having a diameter not larger than 0.1 μm, said fine intermetallic compounds serving to suppress occurrence of the recrystallization and to improve the elongation of the alloy plate material, with the result that the extension property, the squeezing property, the reflare property, etc. are deteriorated in the actual draw forming process or the composite forming process.

As described above, the homogenizing treatment should be carried out for 1 to 30 hours. If the homogenizing treatment time is less than one hour, it is impossible to decrease the amount of the additive elements forming a solid solution within the aluminum matrix, leading to deterioration of the bashing property, though it is certainly possible to form a large number of fine intermetallic compounds. On the other hand, if the homogenizing treatment is carried out for more than 30 hours, the precipitated intermetallic compounds are rendered bulky, though it is certainly possible to decrease the amount of the additive elements forming a solid solution within the aluminum matrix. In this case, a large number of nuclei for recrystallization are likely to be formed in the subsequent homogenizing annealing step, leading to deterioration of the moldability.

The homogenizing treatment described above is immediately followed by a hot rolling treatment. In the present invention, it is necessary to carry out the hot rolling treatment such that the homogenized aluminum alloy plate having a thickness of 100 mm is passed through a hot rolling apparatus at least 7 times so as to decrease the thickness of the homogenized aluminum plate into a desired thickness after the hot rolling step. If the homogenized aluminum alloy plate is passed through a hot rolling apparatus 6 times or less for obtaining a desired thickness of the alloy plate, the thickness reduction of the alloy plate required for each pass is rendered large. Since the restoration and recrystallization are repeated between adjacent passes of the alloy plate through the hot rolling apparatus, a large number of old grain boundaries, which are likely to provide nuclei for the recrystallization in the subsequent homogenizing annealing step, are formed in the hot rolled alloy plate after the final pass through hot rolling apparatus. It follows that the extension property, the squeezing property and the reflare property of the resultant alloy plate are markedly deteriorated in the draw forming step or the composite forming step.

Let us describe the present invention more in detail with reference to Examples which follow:

EXAMPLE 1

Aluminum alloys of the compositions shown in Table 1 were prepared by the water-cooling casting method or continuous casting method (water-cooling rolling method). Both surfaces of an ingot plate having a thickness of 400 mm, which was prepared by a water-cooling casting method, were subjected to cutting such that each surface region was cut away in a thickness of 10 mm. After the cutting, the resultant ingot plate was subjected to a homogenizing treatment (including heating of the ingot plate to a predetermined temperature) and, then, to a hot rolling treatment so as to obtain a hot rolled plate having a thickness of 6 mm. Likewise, cast plates each having a thickness of 5.0 mm or 8.0 mm were prepared by a continuous casting method.

TABLE 1

| | Sample | Alloy Composition (wt %) | | | | | |
|---|---|---|---|---|---|---|---|
| | No. | Si | Fe | Mn | Cu | Ti | Al |
| Present Invention | 1 | 0.07 | 0.25 | 0.30 | — | 0.03 | Balance |
| | 2 | 0.06 | 0.50 | 0.28 | — | 0.05 | Balance |
| | 3 | 0.04 | 0.08 | 0.32 | — | 0.02 | Balance |
| | 4 | 0.05 | 0.78 | 0.34 | — | 0.12 | Balance |
| | 5 | 0.05 | 0.82 | 0.15 | — | 0.08 | Balance |
| | 6 | 0.06 | 0.30 | 0.46 | — | 0.10 | Balance |
| Control Case | 7 | 0.15 | 0.30 | 0.28 | — | — | Balance |
| | 8 | 0.03 | 0.38 | 0.04 | — | 0.01 | Balance |
| | 9 | 0.05 | 0.07 | 0.02 | — | 0.06 | Balance |
| | 10 | 0.04 | 1.40 | 0.72 | — | 0.04 | Balance |
| | 11 | 0.06 | 0.06 | 0.10 | — | 0.20 | Balance |
| Conventional alloy | 12 | 0.03 | 0.55 | 0.01 | 0.12 | 0.01 | Balance |

TABLE 2

| | Manufacturing Step No. | Thickness of Cast Plate (mm) | Homogenizing Treatment (°C.) × (hr) | Hot Rolling Initiating Temperature (°C.) |
|---|---|---|---|---|
| Present Invention (Second Embodiment) | 1 | 400 | 440 × 2.0 | 422 |
| | 2 | 400 | 490 × 2.5 | 467 |
| | 3 | 400 | 520 × 3.5 | 495 |
| | 4 | 400 | 560 × 1.0 | 522 |
| Control method | 5 | 400 | 540 × 8.0 | 468 |
| | 6 | 400 | 420 × 10.0 | 398 |
| | 7 | 400 | 600 × 6.0 | 495 |
| | 8 | 400 | 490 × 5.0 | 420 |
| Conventional method | 9 | 400 | 560 × 6.0 | 468 |
| | 10 | 400 | 600 × 3.0 | 483 |

TABLE 3

| | Manufacturing Step No. | Thickness of Cast Plate (mm) | Homogenizing Treatment (°C.) × (hr) | Hot Rolling Initiating Temperature (°C.) |
|---|---|---|---|---|
| Present Invention (Third Embodiment) | 11 | 12 | — | — |
| | 12 | 8 | — | — |
| | 13 | 5 | — | — |
| Control method | 14 | 25 | — | — |
| | 15 | 1 | — | — |
| Conventional method | 9 | 400 | 560 × 6.0 | 468 |
| | 10 | 400 | 600 × 3.0 | 483 |

A cold rolling treatment was applied to each of the hot rolled plate and the cast plates to obtain thin plates each having a thickness of 0.115 mm or 0.100 mm, followed by applying a homogenizing annealing treatment to each of the cold rolled plates. The homogenizing annealing treatment was applied at 250° to 320° C. in the case of the cold rolled plate involving the water-cooling casting method and at 250° to 350° C. in the case of the cold rolled plate involving the continuous casting method. As a result, obtained was a material used for molding a fin, said material exhibiting a tensile strength of 10.0 to 15.0 kgf/mm$^2$. Tables 4 and 5 show the distribution of the intermetallic compounds and evaluation of the moldability of the fin materials thus obtained.

The distribution of the intermetallic compounds was evaluated by measuring the particle diameter of the intermetallic compound and the number of the compounds present within a predetermined volume of the fin material. A transmitting electron microscope was used for the measurement. The diameter of a circle having an area equal to the projected area of the intermetallic compound particle was actually measured for determining the particle diameter shown in the Tables.

In the test for the moldability, the critical value of the height for the collar formation by the draw forming technique was measured for each of the material plates each having a thickness of 0.100 mm or 0.115 mm. Then, the moldability was evaluated by the molding with an actual forming machine. Specifically, stationary holes of a copper tube having a collar height of 1.6 mm were continuously subjected to extension and squeezing processes by using a draw forming mold and a fin material having a thickness of 0.105 mm and, then, to the final step of the reflare process so as to obtain 960 collars. Further, the number of holes having cracks generated in the tip of the reflare portion (curling portion) was measured so as to calculate the defect rate. The defect rate thus calculated was compared with the defect rate in terms of the reflare cracking in the case of similarly processing the current fin material having a thickness of 0.130 mm so as to evaluate the moldability.

Similarly, the extension, squeezing, bashing and reflare processes were continuously applied by using a composite forming mold so as to obtain 960 collars. Then, the number of holes having cracks formed in the tip of the reflare portion (curling portion) was measured so as to calculate the defect rate, which was compared with the data for the current material so as to evaluate the moldability.

TABLE 4

| Manufacturing method | Sample No. | Alloy No. | Manufacturing step | Number density of intermetallic compounds having diameter not larger than 0.1 μm (compounds/μm³) | Critical value of collar height: Plate thickness (mm) | Critical value of collar height: Height (mm) | Draw Forming: Drawing property | Draw Forming: Reflare property | Composite Forming: Reflare property |
|---|---|---|---|---|---|---|---|---|---|
| Present Invention (Second Embodiment) | 1 | 1 | 1 | 11.2 | 0.100 | 2.0 | ◎ | ○ | ○ |
| | 2 | 2 | 2 | 12.4 | 0.100 | 2.1 | ◎ | ○ | ○ |
| | 3 | 3 | 3 | 13.5 | 0.100 | 2.0 | ◎ | ○ | ○ |
| | 4 | 1 | 4 | 13.7 | 0.100 | 2.0 | ○ | ○ | ○ |
| | 5 | 5 | 1 | 10.8 | 0.100 | 2.0 | ○ | ○ | ○ |
| | 6 | 6 | 4 | 12.3 | 0.100 | 1.9 | ○ | ○ | ○ |
| | 7 | 1 | 1 | 11.2 | 0.115 | 3.2 | ◎ | ○ | ○ |
| | 8 | 4 | 1 | 14.2 | 0.115 | 3.3 | ○ | ○ | ○ |
| Control Case | 9 | 7 | 7 | 6.8 | 0.100 | 1.4 | Δ | x | x |
| | 10 | 8 | 3 | 5.5 | 0.100 | 1.3 | Δ | x | x |
| | 11 | 9 | 4 | 4.3 | 0.100 | 1.2 | x | Δ | x |
| | 12 | 10 | 7 | 4.7 | 0.100 | 1.3 | x | x | x |
| | 13 | 10 | 1 | 10.8 | 0.100 | 1.4 | Δ | x | x |
| | 14 | 11 | 4 | 5.1 | 0.100 | 1.3 | x | ○ | Δ |
| | 15 | 1 | 5 | 3.8 | 0.100 | 1.2 | x | x | x |
| | 16 | 5 | 7 | 4.2 | 0.100 | 1.3 | x | Δ | x |
| | 17 | 6 | 6 | 7.2 | 0.100 | 1.3 | x | ○ | Δ |
| | 18 | 8 | 8 | 6.1 | 0.100 | 1.2 | x | x | x |
| | 19 | 1 | 7 | 4.0 | 0.115 | 2.3 | x | Δ | x |
| Conventional Material | 20 | 12 | 9 | 3.1 | 0.115 | 1.8 | — | — | — |
| | 21 | 12 | 10 | 2.8 | 0.130 | 3.0 | — | — | — |

TABLE 5

| Manufacturing method | Sample No. | Alloy No. | Manufacturing step | Number density of intermetallic compounds having diameter not larger than 0.1 μm (compounds/μm³) | Critical value of collar height: Plate thickness (mm) | Critical value of collar height: Height (mm) | Draw Forming: Drawing property | Draw Forming: Reflare property | Composite Forming: Reflare property |
|---|---|---|---|---|---|---|---|---|---|
| Present Invention (Third Embodiment) | 22 | 6 | 12 | 15.0 | 0.100 | 2.2 | ◎ | ◎ | ◎ |
| | 23 | 4 | 1 | 16.1 | 0.100 | 2.2 | ◎ | ◎ | ◎ |
| | 24 | 1 | 13 | 14.4 | 0.100 | 2.0 | ○ | ○ | ○ |
| Control Case | 25 | 7 | 14 | 6.5 | 0.100 | 1.4 | x | Δ | x |
| | 26 | 2 | 14 | 8.0 | 0.100 | 1.3 | x | Δ | x |
| | 27 | 9 | 5 | 3.9 | 0.100 | 1.2 | x | x | x |
| Conventional Material | 20 | 12 | 9 | 3.1 | 0.115 | 1.8 | — | — | — |
| | 21 | 12 | 10 | 2.8 | 0.130 | 3.0 | — | — | — |

As apparent from Tables 4 and 5, it was possible to apply the draw forming or the composite forming to the alloy plate material in Samples 1 to 8 and 22 to 24 of the present invention. On the other hand, it was impossible to apply the drawing forming or the composite forming to the alloy plate material in conventional Samples 20 and 21, though each of these Samples 20 and 21 had a thickness larger than that of the Samples of the present invention noted above. Particularly, the Samples of the present invention having a thickness of 0.100 mm were found to be superior to the conventional samples in the extension moldability by the draw forming and in the reflare moldability. Also, the Samples of the present invention having a thickness of 0.115 mm were found to be superior to the conventional Samples in the critical value of the height of the collar formation.

In the material of the present invention, intermetallic compounds having a diameter not larger than 0.1 μm are distributed in a greater number than in the conventional material. Thus, when the cold rolled alloy material of the present invention is subjected to the homogenizing annealing treatment, these fine intermetallic compounds in the process texture serve to retard the migration of the boundary phase of the restoring subgrains so as to suppress generation of the nuclei for the recrystallization. It follows that it is possible to retain the mechanical strength required for the composite forming of a thin fin. In addition, it is possible to improve the extension property, squeezing property and reflare property required for the manufacture of fins.

Such being the situation, it is possible for the fin material of the present invention to ensure the critical value of the collar height at least equal to the level of the current thickness (0.130 mm) as shown in Tables 4 and 5, even if the thickness of the alloy material plate is reduced from 0.130 mm to 0.115 mm. It is also possible to ensure a reflare moldability at least equal to that for the current material in the composite forming technique.

On the other hand, Control samples 9–19 and 25–27, which do not fall within the technical scope of the present invention, were found to be inferior to the samples of the present invention in each of the extension property, squeezing property and reflare property in the draw forming technique and in the reflare property in the composite forming technique. Further, the critical value of the collar height for the Control samples noted above was found to be lower than the level for the samples of the present invention.

To be more specific, the amount of any of Si, Fe and Mn contained in Control samples 9, 12, 13 and 25 was larger than the upper limit of the range specified in the present invention, with the result that the intermetallic compounds formed in these Control samples grew bulky. Thus, the amount of the intermetallic compounds having a diameter not larger than 0.1 μm was smaller than the lower limit of the range specified in the present invention. In addition, the precipitates formed in the forging step were rendered bulky. Under the circumstances, the extension property, squeezing property and reflare property were lowered in the molding step, leading to defective molded articles. On the other hand, the Ti content of Control sample 14 was higher than the upper limit of the range specified in the present invention. In this case, Ti-based bulky compounds were distributed within the alloy texture, resulting in failure to form uniform and fine subgrains. Thus, the extension property, squeezing property and reflare property in the molding step were lowered.

Each of Control samples 9, 12, 15–19 and 25–27 did not meet the manufacturing conditions specified in the present invention, with the result that these Control samples were poor in the extension property, squeezing property or the reflare property where an alloy material plate having a thickness of 0.105 mm formed of each of these Control samples was subjected to the draw forming process.

In each of Control samples 15 and 18, the hot rolling treatment was initiated at a temperature lower by at least 50° C. than the temperature for the homogenizing treatment. As a result, the amount of the additive element forming a solid solution was already much lowered in the starting time of the hot rolling treatment. As a matter of fact, the intermetallic compounds larger than 0.1 μm in diameter were found to have been precipitated in the aluminum matrix. Thus, fine intermetallic compounds having a diameter not larger than 0.1 μm were unlikely to be precipitated during the hot rolling treatment, or during both the hot rolling treatment and the finishing annealing treatment after the cold rolling treatment, resulting in failure to obtain the distribution of the intermetallic compounds specified in the present invention. Naturally, the extension property, squeezing property and reflare property were deteriorated in the molding step of the thin fin.

In Control sample 17, the homogenizing treatment was carried out at a temperature lower than the lower limit of the range specified in the present invention, resulting in failure to homogenize sufficiently the ingot texture. In addition, the texture after the hot rolling treatment was rendered nonuniform, leading to deterioration in the extension property and the reflare property in the draw forming process.

In Control samples 25 to 27, the thickness of the cast plate did not fall within the range specified in the method according to the third embodiment of the present invention. In these Control samples, the solidifying state is rendered unstable, or the amount of the additive element forming a solid solution within the aluminum matrix is decreased because of the reduction in the cooling rate. Thus, the intermetallic compounds formed within the aluminum matrix are rendered bulky, resulting in failure to obtain the distribution of the fine intermetallic compounds having a diameter not larger than 0.1 μm specified in the present invention. Naturally, the extension property, squeezing property and reflare property are deteriorated in the molding process.

EXAMPLE 2

Some of the samples of the present invention and the Control samples shown in Tables 4 and 5 were tested for the mechanical strength, i.e., tensile strength, elongation, Ericksen value and critical value of the hole expansion, with the temperature for the homogenizing annealing treatment set at different levels. Table 6 shows the results.

The moldability of the samples was also evaluated as in Example 1. To reiterate, a fin material having a thickness of 0.105 mm was subjected to the extension process, squeezing process, hole-expanding process, bashing process and reflare process by using an extension-squeezing type draw forming mold and a composite forming mold. The moldability was evaluated by comparing the reflare crack defective ratio with that of the current fin material having a thickness of 0.130 mm.

TABLE 6

| | Sample No. | Alloy No. | Manufacturing No. | Mechanical Strength: Plate thickness (mm) | Homogenizing temperature (°C.) | Tensile Strength (kgf/mm²) | Elongation (%) | Ericksen | Hole expansion rate (%) | Draw Forming: Extension property | Draw Forming: Reflare property | Composite Forming Reflare property |
|---|---|---|---|---|---|---|---|---|---|---|---|---|
| Present Invention | 7 | 1 | 1 | 0.115 | 280 | 14.2 | 19.0 | 7.2 | 21.3 | ⊙ | ○ | ○ |
| | | | | | 290 | 13.7 | 23.4 | 7.4 | 24.5 | ⊙ | ○ | ○ |
| | | | | | 300 | 13.5 | 21.2 | 7.3 | 22.9 | ○ | ○ | ○ |
| | 4 | 1 | 4 | 0.100 | 270 | 14.5 | 19.1 | 7.3 | 20.7 | ⊙ | ○ | ○ |
| | | | | | 280 | 13.8 | 22.3 | 7.6 | 23.5 | ⊙ | ○ | ○ |
| | | | | | 290 | 13.3 | 24.4 | 7.8 | 24.3 | ⊙ | ○ | ○ |
| | | | | | 300 | 13.0 | 20.8 | 7.4 | 22.8 | ○ | ○ | ○ |
| | 22 | 6 | 6 | 0.100 | 290 | 15.0 | 19.2 | 7.1 | 20.9 | ○ | ○ | ○ |
| | | | | | 300 | 14.3 | 22.3 | 7.2 | 24.2 | ⊙ | ○ | ○ |
| | | | | | 310 | 13.7 | 21.9 | 7.2 | 24.0 | ⊙ | ○ | ○ |
| Control Case | 18 | 8 | 11 | 0.100 | 260 | 14.3 | 10.9 | 6.0 | 15.9 | x | Δ | x |
| | | | | | 270 | 13.6 | 12.5 | 6.3 | 16.8 | x | x | x |
| | | | | | 280 | 13.0 | 11.4 | 6.2 | 16.3 | x | x | x |
| | 19 | 1 | 10 | 0.115 | 270 | 14.6 | 9.0 | 6.0 | 15.8 | x | x | x |
| | | | | | 280 | 14.0 | 12.6 | 6.4 | 16.4 | x | Δ | x |
| | | | | | 290 | 13.2 | 12.2 | 6.3 | 16.3 | x | x | x |
| Conventional Alloy | 20 | 12 | 14 | 0.130 | 260 | 12.0 | 19.8 | 7.8 | 22.8 | — | — | — |
| | | | | | 270 | 11.4 | 23.4 | 8.1 | 25.6 | | | |
| | | | | | 280 | 10.9 | 25.1 | 9.0 | 26.3 | | | |

Evaluation of Extensiton Property and Reflare Property
⊙: Superior to conventional alloy plate by 20% or more
○: Superior to conventional alloy plate by 10% or more
Δ: Roughly equal to conventional alloy plate
x: Inferior to conventional alloy plate
Note) Moldability Test shown in Tables 4, 5 and 6:
1. Fin plate having a thickness of 0.105 mm was used in the test for extension property and reflare property.
2. Fin plate having a thickness of 0.100 mm or 0.115 mm was used for the tests for the critical value of collar height and for the mechanical properties of the raw material plate.

As apparent from Table 6, the fin material of the present invention is superior to the materials of the Control samples in any of the elongation, Ericksen value and the critical value for the hole-expansion rate while exhibiting a tensile strength substantially equal to that for the Control cases. It follows that the fin material of the present invention is capable of maintaining excellent extension property, squeezing property, bashing property and reflare property in the actual draw forming process and composite forming process.

EXAMPLE 3

Aluminum alloys of the compositions shown in Table 7 were prepared by the water-cool casting method. Each of the both surfaces of the ingot obtained by the water-cool casting method, said ingot having a thickness of 400 mm, were cut by grinding in a thickness of 10 mm, followed by applying a homogenizing treatment and, then, a hot rolling treatment to the resultant ingot plate under the conditions shown in Table 8 so as to obtain a thin plate having a thickness of 0.115 mm or 0.100 mm. Further, a homogenizing annealing treatment was applied to the hot rolled thin plate under temperatures falling within a range of between 250° C. and 320° C. so as to obtain fin materials for the molding, said fin materials having a tensile strength falling within a range of between 10.0 and 15.0 kgf/mm².

TABLE 7

| | Alloy No. | Alloy composition (wt %): Si | Fe | Mn | Cu | Ti | A% |
|---|---|---|---|---|---|---|---|
| Present invention | 1 | 0.07 | 0.25 | 0.30 | — | 0.03 | Balance |
| | 13 | 0.08 | 0.50 | 0.28 | — | 0.05 | " |

TABLE 7-continued

| | Alloy No. | Alloy composition (wt %): Si | Fe | Mn | Cu | Ti | A% |
|---|---|---|---|---|---|---|---|
| | 3 | 0.04 | 0.80 | 0.32 | — | 0.02 | " |
| | 4 | 0.05 | 0.78 | 0.34 | — | 0.12 | " |
| | 5 | 0.05 | 0.82 | 0.15 | — | 0.08 | " |
| | 6 | 0.06 | 0.30 | 0.46 | — | 0.10 | " |
| Control case | 7 | 0.15 | 0.30 | 0.28 | — | — | " |
| | 14 | 0.03 | 0.38 | 0.04 | — | — | " |
| | 9 | 0.05 | 0.07 | 0.02 | — | 0.06 | " |
| | 10 | 0.04 | 1.40 | 0.72 | — | 0.04 | " |
| | 11 | 0.06 | 0.06 | 0.10 | — | 0.20 | " |
| Conventional alloy | 12 | 0.03 | 0.55 | 0.01 | 0.12 | 0.01 | " |

TABLE 8

| | Manufacturing step No. | Homogenizing treatment (°C.) × (hr) | The number of passes through hot rolling apparatus (plate thickness of 100 mm or less) |
|---|---|---|---|
| Present invention | 16 | 430° C. × 20 hr | 11 passes |
| | 17 | 450° C. × 3 hr | 12 passes |
| | 18 | 480° C. × 3 hr | 9 passes |
| | 19 | 470° C. × 9 hr | 10 passes |
| Control case | 20 | 460° C. × 9 hr | 4 passes |
| | 21 | 380° C. × 3 hr | 9 passes |
| | 22 | 560° C. × 6 hr | 5 passes |
| | 23 | 630° C. × 6 hr | 6 passes |
| | 24 | 600° C. × 15 hr | 8 passes |
| Conventional method | 25 | 560° C. × 6.0 hr + 490° C. Reset | 4 passes |

TABLE 8-continued

| | Manufacturing step No. | Homogenizing treatment (°C.) × (hr) | The number of passes through hot rolling apparatus (plate thickness of 100 mm or less) |
|---|---|---|---|
| | 26 | 600° C. × 3.0 hr + 510° C. Reset | 4 passes |

The distribution of the intermetallic compounds and the moldability of the fin materials thus obtained were evaluated as in Example 1, with the results as shown in Table 9.

forming of thin fins. In addition, it is possible to improve the extension property, the squeezing property, bashing property and reflare property in the molding step.

Under the circumstances, it is possible for the fin material of the present invention to ensure the critical value of the collar height at least equal to the current plate thickness of 0.130 mm even in the case of decreasing the plate thickness from 0.130 mm to 0.115 mm. Further, it is possible to maintain the reflare moldability in the composite forming process at least equal to that for the current material.

On the other hand, Control samples 39 to 48 which do not fall within the technical scope of the present invention, are inferior to the samples of the present invention in the extension property, the squeezing property and the reflare

TABLE 9

| | Sample No. | Alloy No. | Manufacturing step | Number density of intermetallic compounds having diameter not larger than 0.1 μm (compounds/μm³) | Critical value of collar height: Plate thickness (mm) | Critical value of collar height: Height (mm) | Draw Forming: Drawing property | Draw Forming: Reflare property | Composite Forming: Reflare property |
|---|---|---|---|---|---|---|---|---|---|
| Present Invention | 28 | 1 | 16 | 16.1 | 0.100 | 2.0 | ◎ | ◎ | ◎ |
| | 29 | 13 | 17 | 15.0 | 0.100 | 2.1 | ◎ | ○ | ○ |
| | 30 | 3 | 18 | 14.4 | 0.100 | 2.0 | ◎ | ○ | ○ |
| | 31 | 1 | 19 | 13.7 | 0.100 | 2.0 | ◎ | ◎ | ○ |
| | 32 | 5 | 17 | 11.2 | 0.100 | 2.0 | ◎ | ○ | ○ |
| | 33 | 6 | 17 | 15.2 | 0.100 | 1.9 | ○ | ○ | ○ |
| | 34 | 6 | 19 | 15.6 | 0.100 | 2.2 | ◎ | ○ | ◎ |
| | 35 | 4 | 18 | 12.3 | 0.100 | 2.2 | ◎ | ○ | ◎ |
| | 36 | 1 | 17 | 14.0 | 0.100 | 2.0 | ○ | ◎ | ○ |
| | 37 | 1 | 16 | 16.1 | 0.115 | 3.2 | ◎ | ○ | ○ |
| | 38 | 4 | 16 | 15.0 | 0.115 | 3.3 | ◎ | ○ | ○ |
| Control Case | 39 | 7 | 23 | 6.8 | 0.100 | 1.4 | Δ | x | x |
| | 40 | 14 | 20 | 5.5 | 0.100 | 1.3 | Δ | x | x |
| | 41 | 9 | 20 | 4.3 | 0.100 | 1.2 | x | x | x |
| | 42 | 10 | 23 | 6.0 | 0.100 | 1.3 | x | x | x |
| | 43 | 10 | 16 | 9.5 | 0.100 | 1.4 | Δ | x | x |
| | 44 | 11 | 19 | 8.0 | 0.100 | 1.3 | x | x | x |
| | 45 | 11 | 24 | 3.0 | 0.100 | 1.4 | x | x | x |
| | 46 | 1 | 23 | 3.8 | 0.100 | 1.2 | x | x | x |
| | 47 | 7 | 22 | 8.2 | 0.100 | 1.3 | x | x | x |
| | 48 | 9 | 21 | 4.4 | 0.100 | 1.3 | x | x | x |
| Conventional Material | 49 | 12 | 25 | 3.1 | 0.115 | 1.8 | — | — | — |
| | 50 | 12 | 26 | 2.8 | 0.130 | 3.0 | — | — | — |

As apparent from Table 9, samples 28 to 38 of the present invention permits a draw forming process or a composite forming process even if the fin material plate is thinner than that for conventional samples 49 and 50. Particularly, the samples of the present invention are superior to the conventional samples in the extension property and the reflare property for the draw forming process applied to an alloy plate material having a thickness of 0.100 mm. Further, the samples of the present invention are superior to the conventional samples in the critical value of the collar height in the case of the alloy plate material having a thickness of 0.115 mm.

It should be noted that the intermetallic compounds having a diameter not larger than 0.1 μm are distributed in the alloy plate material of the present invention a larger amount than in the conventional alloy plate material. Thus, when the cold rolled material of the present invention is subjected to the homogenizing annealing treatment, these fine intermetallic compounds serve to retard the migration of the grain boundary of the restoring subgrains in the processed texture so as to suppress the generation of the nuclei for the recrystallization. It follows that it is possible to maintain the mechanical strength required for the composite property in the draw forming process as well as in the reflare property in the composite forming process. Further, the Control samples are inferior to the samples of the present invention in the critical value of the collar height.

To be more specific, the amount of any of Si, Fe and Mn contained in Control samples 39, 42, 43 and 47 was larger than the upper limit of the range specified in the present invention, with the result that the intermetallic compounds formed in these Control samples grew bulky. Thus, the amount of the intermetallic compounds having a diameter not larger than 0.1 μm was smaller than the lower limit of the range specified in the present invention. In addition, the precipitates formed in the forging step were rendered bulky. Under the circumstances, the extension property, the squeezing property and the reflare property were lowered in the molding step, leading to defective molded articles. On the other hand, the Ti content of each of Control samples 44 and 45 was higher than the upper limit of the range specified in the present invention. In this case, Ti-based bulky compounds were distributed within the alloy texture, resulting in failure to form uniform and fine subgrains. Thus, the extension property, the squeezing property and the reflare property in the molding step were lowered.

Each of Control samples 39–42 and 45–48 did no meet the manufacturing conditions specified in the present invention, with the result that these Control samples were poor in the extension property, the squeezing property or the reflare property where an alloy material plate having a thickness of 0.105 mm formed of each of these Control samples was subjected to the draw forming process.

A homogenizing treatment was applied to Control sample 45 under the conditions specified in the present invention. However, the ordinary hot rolling treatment was applied to this Control sample. In this case, the old grain boundaries are generated in a large amount, resulting in failure to improve sufficiently the extension property and the reflare property. It follows that the moldability is markedly impaired. On the other hand, the hot rolling treatment was applied to Control sample 48 under the conditions specified in the present invention. In this case, however, the homogenizing treatment was applied under the temperature lower than the lower limit of the range specified in the present invention. As a result, the ingot texture was not sufficiently homogenized in Control sample 48, and the texture after the hot rolling treatment was rendered nonuniform. In this case, the material tends to be hardened during the process so as to impair the bashing property. Further, the homogenizing treatment was applied to Control sample 44 under the temperature higher than the upper limit of the range specified in the present invention. In this case, the amount of the additive element forming a solid solution within the aluminum matrix was markedly lowered. As a matter of fact, bulky intermetallic compounds having a diameter larger than 0.1 μm were found to have been precipitated within the aluminum matrix, leading to deterioration in the extension property and the reflare property in the step of molding thin fins.

EXAMPLE 4

Some of the samples of the present invention and the Control samples shown in Table 9 were tested for the mechanical strength, i.e., tensile strength, elongation, Ericksen value and critical value of the hole expansion, with the temperature for the homogenizing annealing treatment set at different levels. Table 10 shows the results.

The moldability of the samples was also evaluated as in Example 1. To reiterate, a fin material having a thickness of 0.105 mm was subjected to the extension process, the squeezing process, the hole-expanding process, the bashing process and the reflare process by using an extension-squeezing type draw forming mold and a composite forming mold. The moldability was evaluated by comparing the reflare crack defective ratio with that of the current fin material having a thickness of 0.130 mm.

TABLE 10

| | | | | Mechanical Strength | | | | | | Draw Forming | | Composite |
|---|---|---|---|---|---|---|---|---|---|---|---|---|
| | Sample No. | Alloy No. | Manufacturing No. | Plate thickness (mm) | Homogenizing temperature (°C.) | Tensile Strength (kgf/mm²) | Elongation (%) | Ericksen | Hole expansion rate (%) | Extension property | Reflare property | Forming Reflare property |
| Present Invention | 36 | 1 | 16 | 0.115 | 280 | 14.3 | 19.0 | 7.2 | 21.3 | ⊙ | o | o |
| | | | | | 290 | 13.8 | 23.4 | 7.4 | 24.5 | ⊙ | o | o |
| | | | | | 300 | 13.6 | 21.2 | 7.3 | 22.9 | o | o | o |
| | 30 | 1 | 19 | 0.100 | 270 | 14.6 | 19.1 | 7.3 | 20.7 | ⊙ | o | o |
| | | | | | 280 | 13.8 | 22.3 | 7.6 | 23.5 | ⊙ | o | o |
| | | | | | 290 | 13.4 | 24.4 | 7.8 | 24.3 | ⊙ | o | o |
| | | | | | 300 | 13.1 | 20.8 | 7.4 | 22.8 | o | o | o |
| | 32 | 6 | 17 | 0.100 | 290 | 15.2 | 19.2 | 7.1 | 20.9 | o | o | o |
| | | | | | 300 | 14.4 | 22.3 | 7.2 | 24.2 | ⊙ | o | o |
| | | | | | 310 | 13.8 | 21.9 | 7.2 | 24.0 | ⊙ | o | o |
| Control Case | 41 | 10 | 23 | 0.100 | 270 | 14.3 | 10.9 | 6.0 | 15.9 | x | Δ | Δ |
| | | | | | 280 | 13.6 | 12.5 | 6.3 | 16.8 | x | x | x |
| | | | | | 290 | 13.0 | 11.4 | 6.2 | 16.3 | x | x | x |
| | 46 | 7 | 22 | 0.115 | 270 | 14.6 | 9.0 | 6.0 | 15.8 | x | x | x |
| | | | | | 280 | 14.0 | 12.6 | 6.4 | 16.4 | x | x | x |
| | | | | | 290 | 13.2 | 12.2 | 6.3 | 16.3 | x | x | x |
| Conventional Alloy | 49 | 12 | 26 | 0.130 | 260 | 12.0 | 19.8 | 7.8 | 22.8 | — | — | — |
| | | | | | 270 | 11.4 | 23.4 | 8.1 | 25.6 | | | |
| | | | | | 280 | 10.9 | 25.1 | 9.0 | 26.3 | | | |

Evaluation of Extensiton Property and Reflare Property
⊙: Superior to conventional alloy plate by 20% or more
o: Superior to conventional alloy plate by 10% or more
Δ: Roughly equal to conventional alloy plate
x: Inferior to conventional alloy plate
Note) Moldability Test shown in Tables 9 and 10:
1. Fin plate having a thickness of 0.105 mm was used in the test for extension property and reflare property.
2. Fin plate having a thickness of 0.100 mm or 0.115 mm was used for the tests for the critical value of collar height and for the mechanical properties of the raw material plate.

As apparent from Table 10, the fin material of the present invention is superior to the materials of the Control samples in any of the elongation, Ericksen value and the critical value for the hole-expansion rate while exhibiting a tensile strength substantially equal to that for the Control cases. It follows that the fin material of the present invention is capable of maintaining excellent extension property, bashing property and reflare property in the actual draw forming process and composite forming process.

As described above in detail, the fin material prepared by the method of the present invention produces prominent effects. Specifically, the fin material is capable of maintaining excellent extension property, squeezing property, bashing property and reflare property in the actual draw forming process and composite forming process, leading to a marked reduction in the defectiveness in terms of the cracking in the molding step. Needless to say, the fin material of the present invention can also be applied to the drawless forming technique. Particularly, since it is possible to achieve a collar height of 1.8 to 2.2 mm by using a draw forming mold even in the case of using a fin material having a thickness as small as 0.100 mm, it is possible to markedly reduce the facility cost and the material cost.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method of manufacturing a high strength aluminum alloy suitable for a fin having a collar portion and having a thickness of not larger than 0.105 mm and comprising the steps of:

continuously supplying an aluminum alloy melt containing at most 0.1% by weight of Si, 0.10 to 1.0% by weight of Fe, 0.1 to 0.50% by weight of Mn, 0.01 to 0.15% by weight of Ti, and the balance of Al and unavoidable impurities, to the outer circumferential surfaces of a pair of cooling molds disposed to face each other and rotated in a sliding contact with each other, to obtain a cast plate having a thickness of 2 to 15 mm;

applying a cold rolling treatment to the resultant cast plate such that the final rate of reduction in the thickness of the cast plate is at least 80%; and applying a homogenizing annealing treatment to the cold rolled thin plate at 250° to 320° C. to cause intermetallic compounds having a diameter not larger than 0.1 μm to be distributed within the metal texture of the alloy in a number density of at least $10/\mu m^3$.

2. A fin for an air conditioner, said fin being made of a high strength aluminum alloy having a thickness of not larger than 0.105 mm, said aluminum alloy containing at most 0.1% by weight of Si, 0.12 to 1.0% by weight of Fe, 0.1 to 0.46% by weight of Mn, 0.01 to 0.15% by weight of Ti, and the balance of Al and unavoidable impurities; and intermetallic compounds having a diameter not larger than 0.1 μm being distributed within the metal texture of the alloy in a number density of at least $10/\mu m^3$.

* * * * *